US011817000B2

(12) United States Patent
Singh

(10) Patent No.: US 11,817,000 B2
(45) Date of Patent: Nov. 14, 2023

(54) SYSTEM AND METHOD TO REDUCE RUNWAY OCCUPANCY TIME USING PSEUDO THRESHOLD

(71) Applicant: Rockwell Collins, Inc., Cedar Rapids, IA (US)

(72) Inventor: Jaibir Singh, Bangalore (IN)

(73) Assignee: Rockwell Collins, Inc., Cedar Rapids, IA (US)

( * ) Notice: Subject to any disclaimer, the term of this patent is extended or adjusted under 35 U.S.C. 154(b) by 305 days.

(21) Appl. No.: 17/217,011

(22) Filed: Mar. 30, 2021

(65) Prior Publication Data

US 2022/0189324 A1 Jun. 16, 2022

(30) Foreign Application Priority Data

Dec. 10, 2020 (IN) ..... 202011053787

(51) Int. Cl.
*G08G 5/02* (2006.01)
*G08G 5/00* (2006.01)

(52) U.S. Cl.
CPC ..... *G08G 5/025* (2013.01); *G08G 5/0013* (2013.01); *G08G 5/0021* (2013.01); *G08G 5/0078* (2013.01)

(58) Field of Classification Search
CPC .... G08G 5/025; G08G 5/0013; G08G 5/0021; G08G 5/0078; G08G 5/0091
See application file for complete search history.

(56) References Cited

U.S. PATENT DOCUMENTS

| | | | | |
|---|---|---|---|---|
| 2,609,437 | A | 9/1952 | Garbell | |
| 8,207,867 | B2 | 6/2012 | Jeddi | |
| 8,515,601 | B2 | 8/2013 | Hugues | |
| 10,037,704 | B1 | 7/2018 | Myr | |
| 10,046,856 | B2 * | 8/2018 | Lee | G05D 1/0669 |

(Continued)

FOREIGN PATENT DOCUMENTS

| | | | |
|---|---|---|---|
| JP | 2014041568 | A | 3/2014 |
| JP | 2018114965 | A | 7/2018 |
| WO | 2002099769 | A1 | 12/2002 |

OTHER PUBLICATIONS

Extended Search Report in European Application No. 21212582.7 dated Apr. 26, 2022, 8 pages.

*Primary Examiner* — Frederick M Brushaber
(74) *Attorney, Agent, or Firm* — Suiter Swantz pc llo

(57) ABSTRACT

A system and method to assist piloting an aircraft in landing phase is disclosed. The system includes a pseudo glide path calculation module that includes a processor and a memory communicatively coupled to the one processor and having instructions stored upon. The instructions, when executed by the processor, cause the one or more processors to receive coordinates for a runway, receive exit path coordinates for a runway, receive aircraft configuration data, receive aircraft status data, receive runway environmental data, calculate a relative position of the aircraft in reference to the exit path coordinates and the runway environmental data, generate a pseudo displaced threshold for the runway, and generate a pseudo approach glide path profile based on the pseudo displaced threshold. The pseudo displaced threshold and the pseudo approach glide path profile may be depicted on a display. A runway occupation time may also be calculated.

10 Claims, 7 Drawing Sheets

(56) References Cited

U.S. PATENT DOCUMENTS

| | | | | |
|---|---|---|---|---|
| 10,150,573 | B2 * | 12/2018 | Wong | G01C 23/00 |
| 10,202,204 | B1 | 2/2019 | Daidzic | |
| 10,248,870 | B2 * | 4/2019 | Ding | G06V 10/25 |
| 10,290,217 | B1 * | 5/2019 | Ramachandra | G01C 23/00 |
| 10,339,817 | B1 * | 7/2019 | McGaughy | G08G 5/0021 |
| 10,351,241 | B2 * | 7/2019 | Pfoertzsch | G06V 20/17 |
| 10,684,619 | B2 * | 6/2020 | Kuhara | G08G 5/0034 |
| 10,693,578 | B1 * | 6/2020 | Shapiro | H04H 20/55 |
| 10,699,588 | B2 * | 6/2020 | Marik | G01C 21/3492 |
| 10,755,588 | B2 * | 8/2020 | Antonini | G06Q 10/06312 |
| 10,769,946 | B1 * | 9/2020 | Harstad | G08G 1/012 |
| 10,776,930 | B2 * | 9/2020 | Perry | G06T 7/246 |
| 10,957,205 | B2 * | 3/2021 | Li | H04W 4/029 |
| 11,004,348 | B1 * | 5/2021 | Lahr | G08G 5/025 |
| 11,023,788 | B2 * | 6/2021 | Huberman | B60W 50/14 |
| 11,076,419 | B2 * | 7/2021 | Lee | H04L 5/0053 |
| 11,093,868 | B2 * | 8/2021 | Kirsanov | G06Q 10/06314 |
| 11,100,726 | B2 * | 8/2021 | Krupa | G07C 5/0841 |
| 11,170,656 | B2 * | 11/2021 | Gärtner | G08G 5/0008 |
| 11,171,713 | B2 * | 11/2021 | Kuo | G08C 17/02 |
| 11,176,838 | B2 * | 11/2021 | Chartier | G08G 5/0008 |
| 11,238,742 | B2 * | 2/2022 | Srinivasan | G08G 5/0026 |
| 11,260,838 | B2 * | 3/2022 | Kanagarajan | B60T 7/22 |
| 11,305,886 | B1 * | 4/2022 | Gilbert | B64D 43/00 |
| 11,348,474 | B2 * | 5/2022 | Venkataraman | G08G 5/0052 |
| 11,354,030 | B2 * | 6/2022 | Tanabe | G06F 3/017 |
| 11,416,008 | B2 * | 8/2022 | Petersen | G08G 5/0013 |
| 11,449,077 | B2 * | 9/2022 | Conway | G08G 5/0026 |
| 11,475,779 | B2 * | 10/2022 | Erignac | G08G 5/0021 |
| 11,479,365 | B2 * | 10/2022 | Chen | B64D 47/08 |
| 11,507,904 | B1 * | 11/2022 | Oleyarsh | G06Q 10/06311 |
| 2002/0077743 | A1 | 6/2002 | Schmidt | |
| 2005/0006524 | A1 | 1/2005 | Villaume et al. | |
| 2008/0162092 | A1 | 7/2008 | Coulmeau et al. | |
| 2010/0070115 | A1 | 3/2010 | Villaume | |
| 2010/0217510 | A1 | 8/2010 | Deker | |
| 2013/0278444 | A1 * | 10/2013 | Venkataswamy | G08G 5/0021 340/972 |
| 2015/0120098 | A1 | 4/2015 | Catalfamo et al. | |
| 2017/0032683 | A1 * | 2/2017 | Meserole, Jr | G08G 5/0082 |
| 2017/0129623 | A1 | 5/2017 | Brardo et al. | |
| 2018/0061243 | A1 * | 3/2018 | Shloosh | G08G 5/0043 |
| 2018/0122250 | A1 | 5/2018 | Wapenski et al. | |
| 2018/0208165 | A1 | 7/2018 | Slatkin | |
| 2019/0251852 | A1 * | 8/2019 | Moll | G08G 5/0021 |

* cited by examiner

SYSTEM AND METHOD TO REDUCE RUNWAY OCCUPANCY TIME USING PSEUDO THRESHOLD

CROSS-REFERENCE TO RELATED APPLICATIONS

The present application claims the benefit under 35 U.S.C. § 119(e) of Indian Provisional Application Ser. No. 202011053787 filed Dec. 10, 2020, which is hereby incorporated by reference in its entirety.

BACKGROUND

Runways at airports are becoming increasingly more congested as the number of flights worldwide continues to increase. The increased congestion often results in increased delays for flights as there are a limited number of runways at airports, creating a bottleneck for takeoffs and landing. Air traffic controllers may try to alleviate runway congestion by decreasing the time between landings. However, decreasing the time between landings may increase risk of collision and/or damage due to wake turbulence from a preceding aircraft. Therefore, it would be advantageous to provide a solution that cures the shortcomings described above.

SUMMARY

A system to assist piloting an aircraft in landing phase is disclosed. In one or more embodiments, the system includes a pseudo glide path calculation module. In some embodiments, the pseudo glide path calculation module includes one or more processors. In some embodiments, the pseudo glide path calculation module includes a memory communicatively coupled to the one or more processors and having instructions stored upon. In some embodiments, the instructions, when executed by the one or more processors, cause the one or more processors to receive coordinates for a runway, receive exit path coordinates for a runway, receive aircraft configuration data, receive aircraft status data, and receive runway environmental data. In some embodiments, the instructions, when executed by the one or more processors, cause the one or more processors to calculate a relative position of the aircraft in reference to the exit path coordinates and the runway environmental data. In some embodiments, the instructions, when executed by the one or more processors, cause the one or more processors to generate a pseudo displaced threshold for the runway. In some embodiments, the instructions, when executed by the one or more processors, cause the one or more processors to generate a pseudo approach glide path profile based on the pseudo displaced threshold.

In some embodiments of the system, the system further includes an aircraft status database configured to send aircraft configuration data to the pseudo glide path calculation module.

In some embodiments of the system, the system further includes a runway database configured to send at least one of the coordinates for the runway or the coordinates for the exit path of the runway to the pseudo glide path calculation module.

In some embodiments of the system, the instructions stored upon the memory further include calculating at least one of an estimated runway occupation time or an actual runway occupation time.

In some embodiments of the system, the system further includes a transmitter configured to transmit at least one of the estimated runway occupation time or the actual runway occupation time to an air traffic system.

In some embodiments of the system, the runway environmental data comprises at least one of an estimated landing time, an estimated landing speed, or an estimated wake turbulence of a preceding aircraft landing on the runway.

In some embodiments of the system, the pseudo displaced threshold is configured to include a margin of safety.

In some embodiments of the system, the system further includes a display configured to depict at least one of the pseudo displaced threshold or the pseudo approach glide path profile.

In some embodiments of the system, the instructions stored upon the memory further include generating a go-around point.

In some embodiments of the system, the approach pseudo glide path is configured to decrease runway occupation time. A pseudo glide path calculation module is disclosed. In some embodiments, the pseudo glide path calculation module includes one or more processors. In some embodiments, the pseudo glide path calculation module includes a memory communicatively coupled to the one or more processors and having instructions stored upon. In some embodiments, the instructions, when executed by the one or more processors, cause the one or more processors to receive coordinates for a runway, receive exit path coordinates for a runway, receive aircraft configuration data, receive aircraft status data, and receive runway environmental data. communicatively coupled to the one or more processors and having instructions stored upon. In some embodiments, the instructions, when executed by the one or more processors, cause the one or more processors to calculate a relative position of the aircraft in reference to the exit path coordinates and the runway environmental data. In some embodiments, the instructions, when executed by the one or more processors, cause the one or more processors to generate a pseudo displaced threshold for the runway. In some embodiments, the instructions, when executed by the one or more processors, cause the one or more processors to generate a pseudo approach glide path profile based on the pseudo displaced threshold.

In some embodiments of the pseudo glide path calculation module, the instructions stored upon the memory further include calculating at least one of an estimated runway occupation time or an actual runway occupation time.

In some embodiments of the pseudo glide path calculation module, the instructions stored upon the memory further include sending at least one of the estimated runway occupation time or the actual runway occupation time to an air traffic system to a transmitter configured to transmit at least one of the estimated runway occupation time or actual runway occupation time to the air traffic system.

In some embodiments of the pseudo glide path calculation module, the runway environmental data includes at least one of an estimated landing time, and estimated landing speed, or an estimated wake turbulence of a preceding aircraft landing on the runway.

In some embodiments of the pseudo glide path calculation module the pseudo approach glide path profile is configured to include a margin of safety.

In some embodiments of the pseudo glide path calculation module, the instructions stored upon the memory further include sending the pseudo approach glide path profile to a display configured to depict the pseudo approach glide path profile.

A method to assist piloting of an aircraft in landing phase is also disclosed. In one or more embodiments of the method, the method includes receiving coordinates for a runway. In one or more embodiments of the method, the method includes receiving exit path coordinates for the runway. In one or more embodiments of the method, the method includes receiving aircraft status data. In one or more embodiments of the method, the method includes receiving runway environmental data. In one or more embodiments of the method, the method includes generating a pseudo displaced threshold for the runway via a pseudo glide path calculation module. In one or more embodiments of the method, the method includes calculating a relative position of the aircraft in reference to the exit path coordinates and the aircraft status data. On one or more embodiments of the method, the method includes generating a pseudo approach glide path profile based on the pseudo displaced threshold via the pseudo glide path calculation module.

In some embodiments of the method, the method further includes generating at least one of an estimated runway occupation time or an actual runway occupation time via the pseudo glide path calculation module. In some embodiments of the method, the method includes transmitting the estimated runway occupation time or the actual runway occupation time.

In some embodiments of the method, the runway environmental data includes at least one of an estimated landing time, and estimated landing speed, or an estimated wake turbulence of a preceding aircraft landing on the runway.

In some embodiments of the method, the pseudo approach glide path profile is configured to include a margin of safety.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are example and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims. In the drawings:

DETAILED DESCRIPTION

Figure 1A:
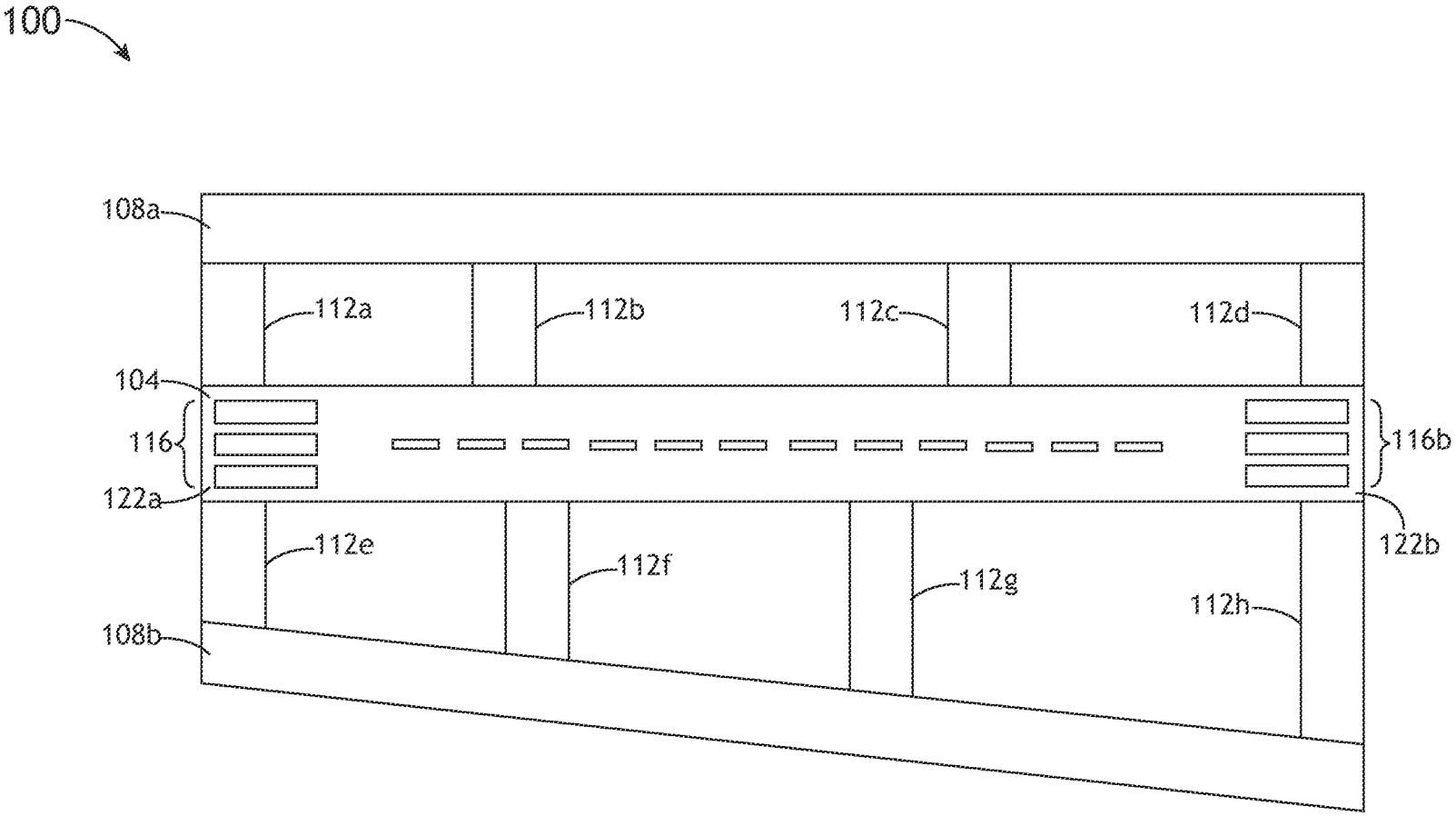
FIG. 1A is a diagram illustrating a runway layout configured with threshold markings, in accordance with one or more embodiments of this disclosure.

Before explaining one or more embodiments of the disclosure in detail, it is to be understood that the embodiments are not limited in their application to the details of construction and the arrangement of the components or steps or methodologies set forth in the following description or illustrated in the drawings. In the following detailed description of embodiments, numerous specific details may be set forth in order to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination of sub-combination of two or more such features, along with any other features which may not necessarily be expressly described or inherently present in the instant disclosure.

A system to assist piloting an aircraft in landing phase is disclosed. Specifically, the system is configured to calculate a pseudo approach glide path profile for a landing aircraft. By calculating the pseudo approach glide path profile, the system may increase the efficiency of runway usage in a safe manner.

Aircraft are increasingly used for transport of people and cargo. As aircraft usage increases, the availability of airport runways often becomes a bottleneck, as runway building often does not increase with aircraft flight demand. Pilots and air traffic controllers often attempt to reduce runway congestion by reducing the time between landings at a particular runway. Reducing the time between landings can be dangerous, because an aircraft that attempts to land too close to a preceding aircraft risks crashing due to wake turbulence caused by the preceding aircraft.

In this disclosure, the system is configured to receive flight landing information for a specific runway (e.g., such as the status of the preceding landing, or an exit path the aircraft is instructed to take), and determine a pseudo displaced threshold point from which a pseudo approach glide path profile may be calculated. Once the pseudo approach glide path profile is calculated, the aircraft may follow the pseudo approach glide path profile to a safe landing that efficiently places the aircraft near an exit path. The system is configured to decrease runway occupation time, resulting in increased flights per runway per unit time and increased fuel savings due to decreased taxi time.

FIG. 1A-E are diagrams illustrating a runway layout 100, in accordance with one or more embodiments of this disclosure. The runway layout includes a runway 104, one or more taxiways 108*a-b* and one or more exit paths 112*a-h* that link the runway 104 to the one or more taxiways 108*a-b*. The runway 104 may also include one or more markings. For example, the runway may include one or more threshold markings 116*a-b* that define the runway threshold 122*a-b* (e.g., beginning or end) of the landing area of the runway. Instance, the length between two threshold markings 116*a-b* may define the space by which a landing may occur.

Figure 1B:
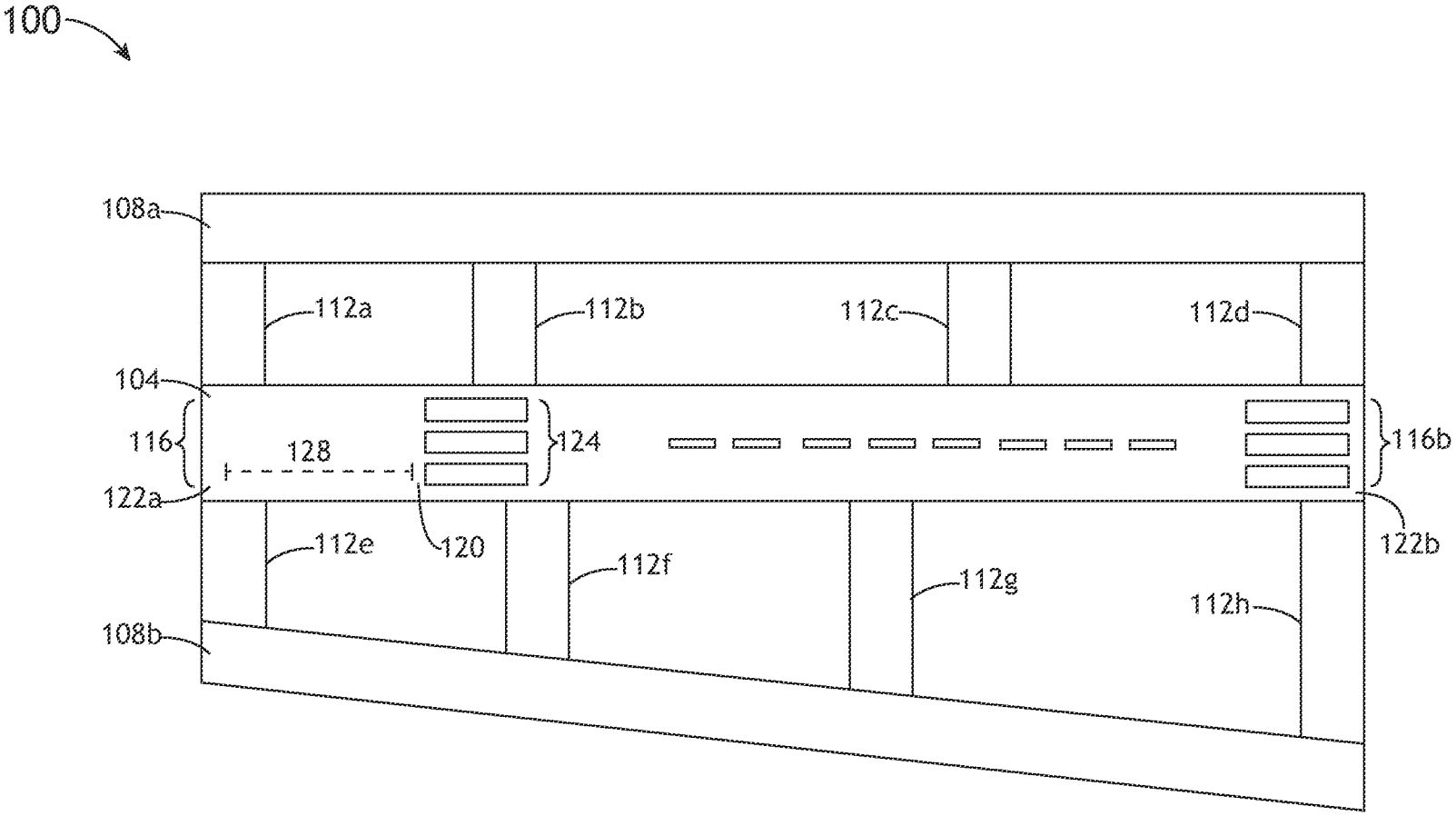
FIG. 1B is a diagram illustrating a runway layout configured with displaced threshold markings, in accordance with one or more embodiments of this disclosure.
Figure 1C:
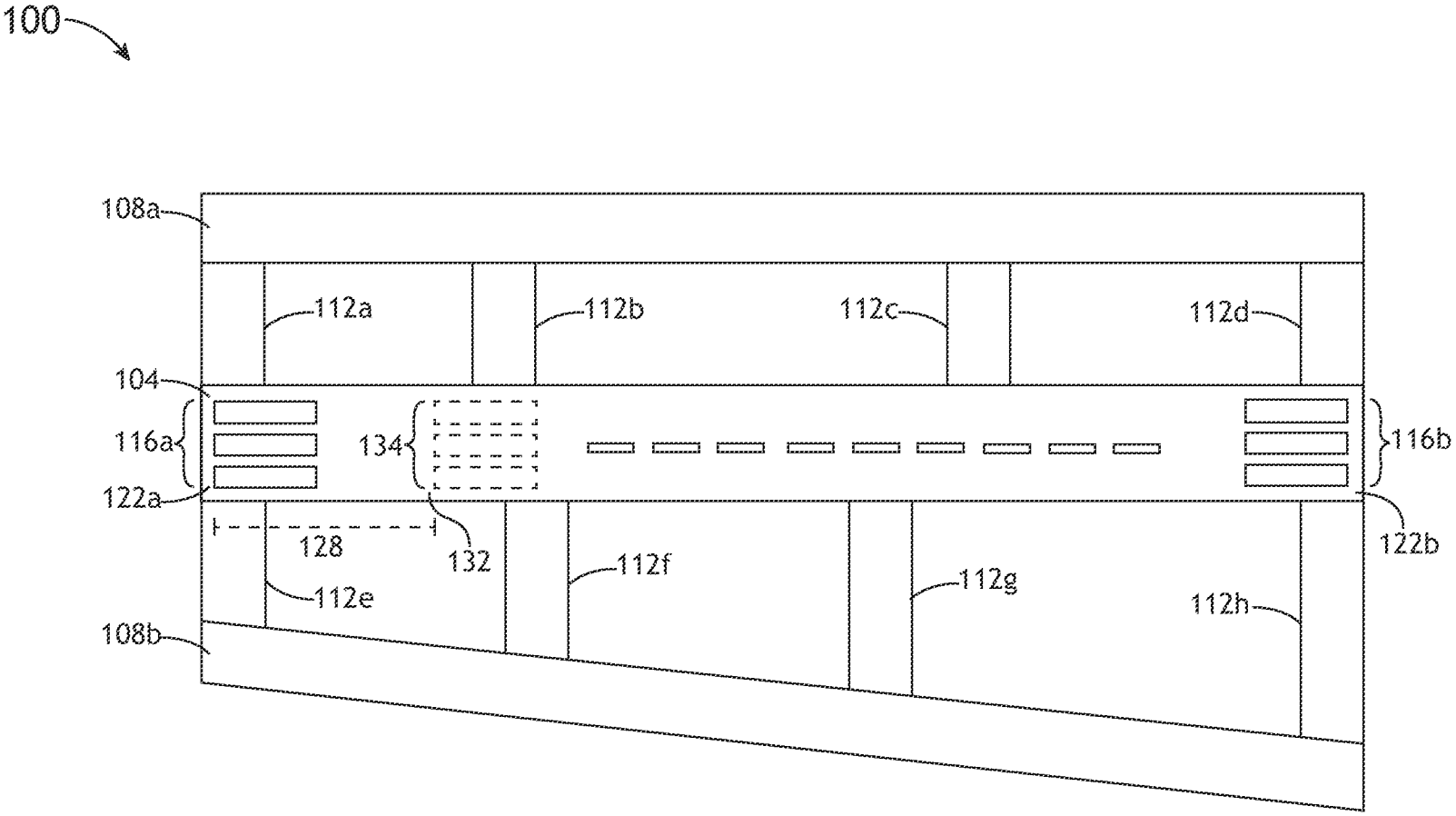
FIG. 1C is a diagram illustrating a runway layout configured with pseudo displaced threshold markings, in accordance with one or more embodiments of this disclosure.

The runway may include a displaced runway threshold 120 (e.g., as shown in FIG. 1B). The displaced runway threshold 120 is a runway threshold 116 located at a point other than the physical beginning or end of the runway 104. The displaced threshold 120 is marked by displaced threshold markings 124. The displaced threshold markings 124 and the physical end of the runway 104 define a displaced portion 128 of the runway 104. The displaced portion 128 of the runway 104 is typically used for takeoff, but not for landing. For example, the displaced portion 128 may be a section of the runway 104 that is no longer able to sustain the continuous impact from landing aircraft, but may still be operable for aircraft to initiate takeoff.

In some embodiments, the aircraft layout 100 includes a pseudo displaced threshold 132 as indicated by pseudo displaced threshold markings 134. The pseudo displaced threshold 132 is a virtualized threshold that is calculated by an aircraft for landing purposes. For example, a pseudo displaced threshold 132 may be calculated in order to decrease the time that the aircraft is on the runway. For example, for an aircraft that has been instructed to turn off on the exit path 112*h* that is furthest down the runway 104, the aircraft may calculate a pseudo displaced threshold 132 further down the runway 104, which increased the displaced portion 128 of the runway, and decreases the length of the used runway, and may decrease the time that the aircraft is on the runway, as the aircraft will turn off to the exit path 112*h* sooner than if the aircraft had initiated landing at the original runway threshold 122*a*.

Figure 1D:
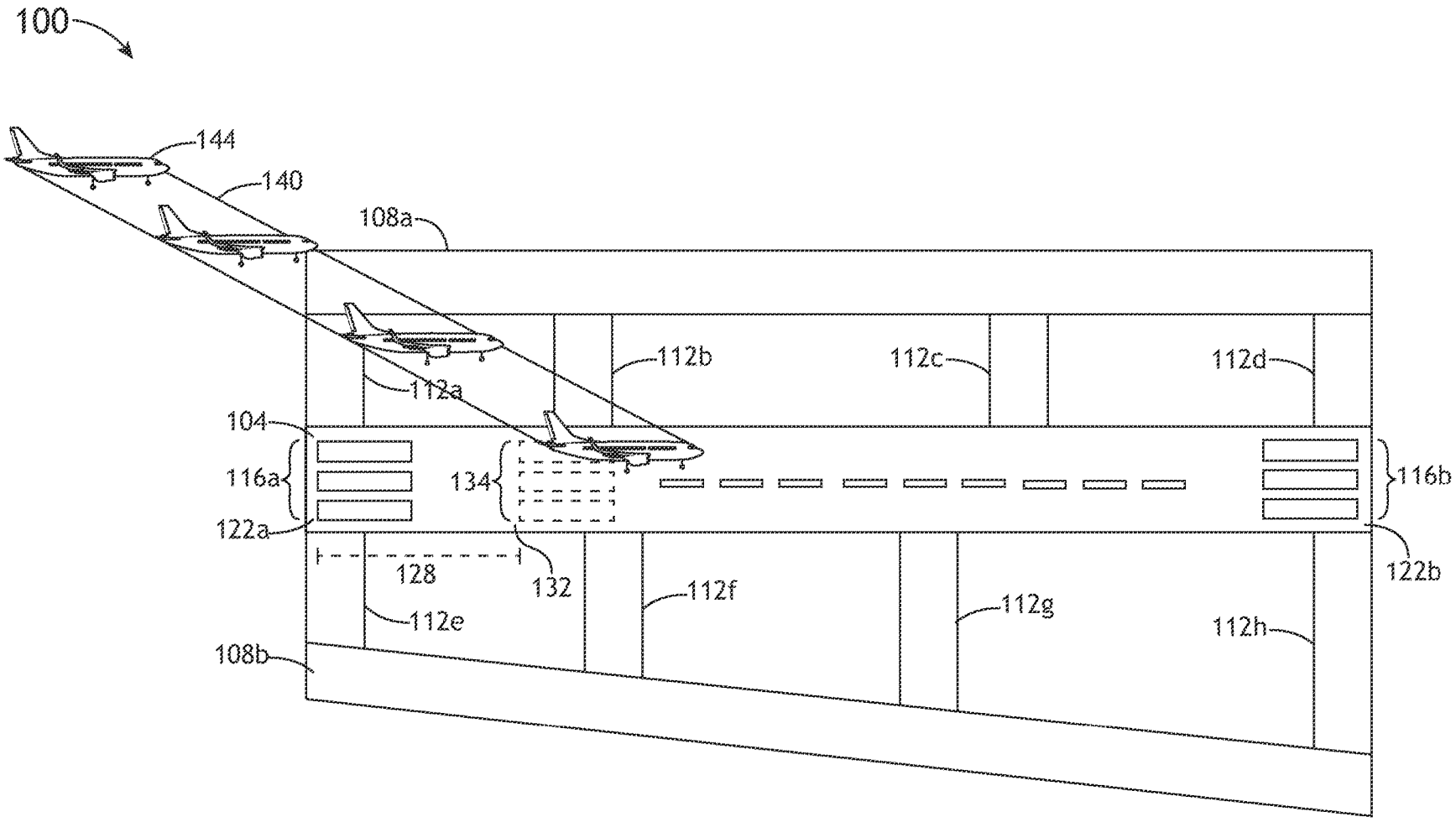
FIG. 1D is a diagram illustrating a runway layout configured with a pseudo approach glide path profile.
Figure 1E:
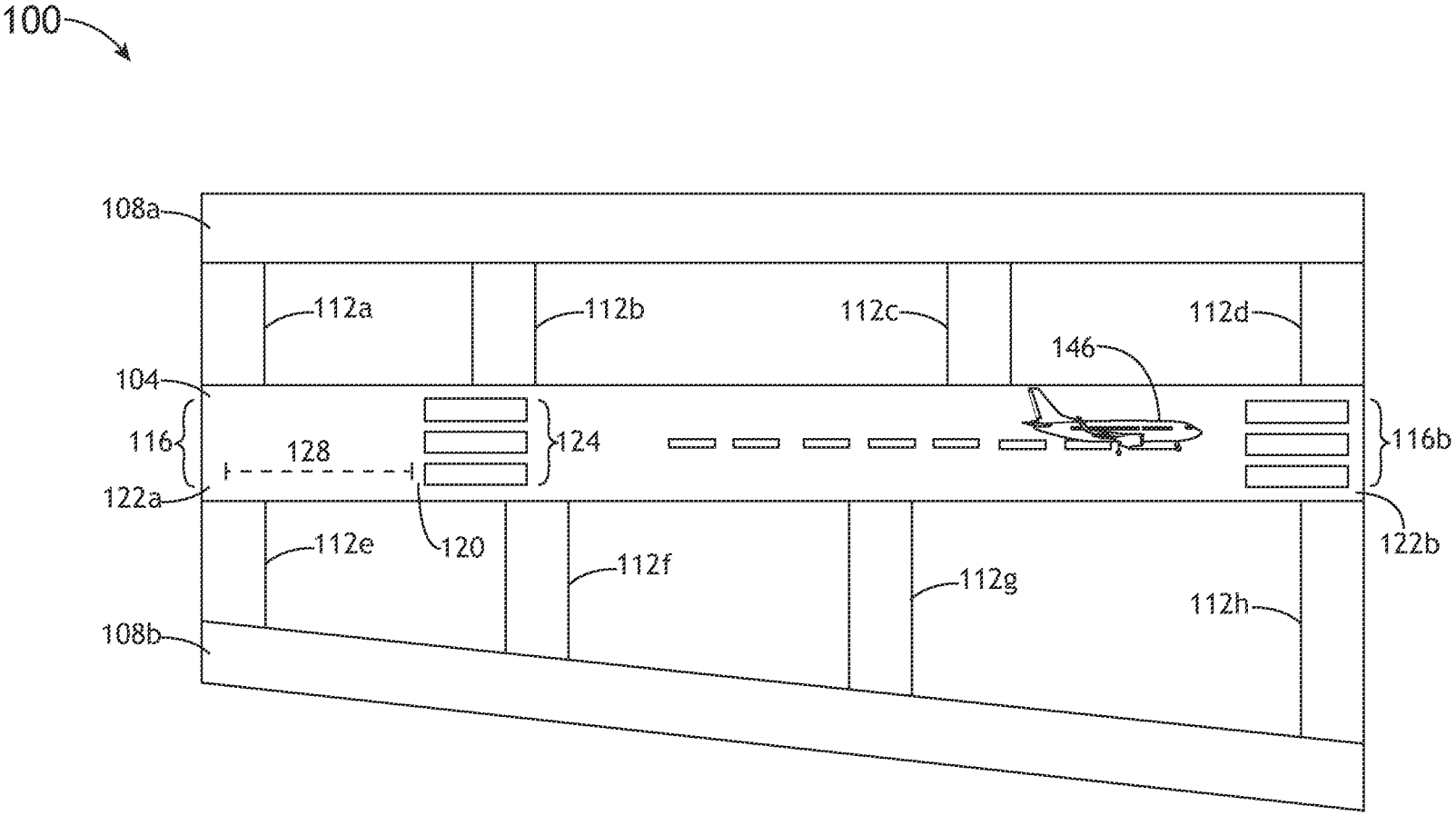
FIG. 1E is a diagram illustrating a runway layout configured with a preceding aircraft disposed on the runway, in accordance with one or more embodiments of this disclosure.

In some embodiments, the pseudo displaced threshold is used to calculate a pseudo approach glide path profile 140 (e.g., as shown on FIG. 1D, along with a representative aircraft 144). Glid paths typically follow a 3° approach that is calculated to land at or near the runway threshold 116 or the displaced runway threshold 120. Once the pseudo displaced threshold is determined, the pseudo approach glide path profile 140 may then be calculated.

In another example, the pseudo displaced threshold 132 may be calculated by an aircraft to ensure that the landing will not be affected by wake turbulence that has formed behind a preceding aircraft 146 (e.g., as shown in FIG. 146). Wake turbulence is a disturbance in the atmosphere that forms behind the preceding aircraft 146 as it passes through the air (e.g., during flight, takeoff, or landing) that can be hazardous to following aircraft. The pseudo displaced threshold 132 may be calculated by taking into account the characteristics of the preceding aircraft 146 (e.g., type of aircraft, known wake turbulence characteristics of the aircraft) and/or the assigned exit path 112*a-h*.

Figure 2:
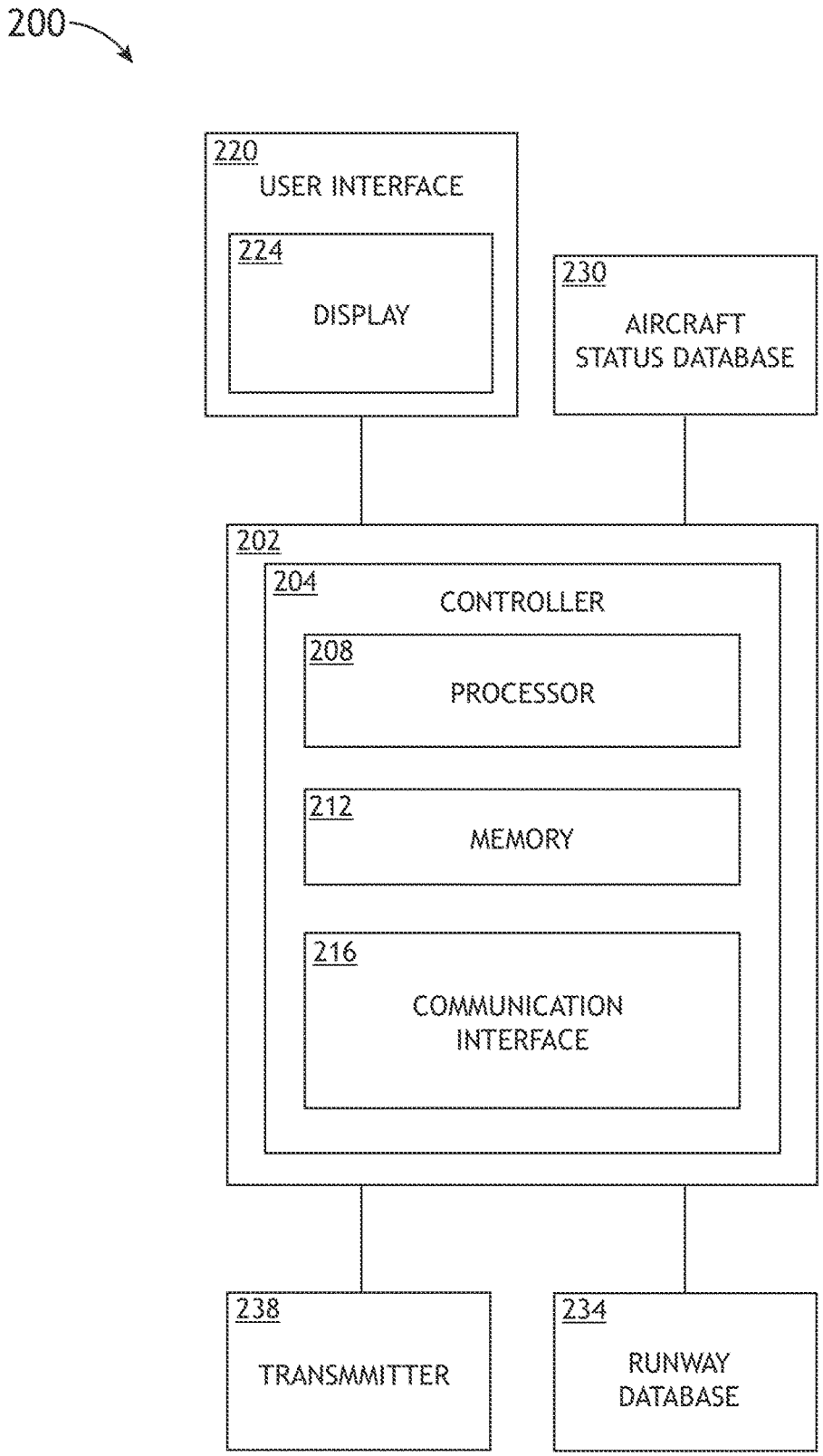
FIG. 2 is a block diagram illustrating a system for generating a pseudo approach glide path profile, in accordance with one or more embodiments of this disclosure.

FIG. 2 is a diagram illustrating a system 200 for determining the pseudo displaced threshold 132 and the pseudo approach glide path profile 140, in accordance with one or more embodiments of the disclosure. In some embodiments, the system 200 includes a pseudo glide path calculation module 202 configured to calculate the pseudo displaced threshold 132 and the pseudo approach glide path profile 140. The pseudo glide path calculation module 202 may be configured as any type of module or part of a system. For example, the pseudo glide path calculation module 202 may be configured as a module within a flight data processing system (e.g., flight management equipment or a system capable of processing flight data). The flight data processing system may also be configured as a flight management system. For instance, the flight data processing system may be configured to determine both the pseudo displaced threshold 132 and the pseudo approach glide path profile 140 via the pseudo glide path calculation module. In another example, the pseudo glide path calculation module 202 may be configured as a module within an instrument landing system. In another example, the pseudo glide path calculation module may be configured as a stand-alone module in an aircraft 144. In another example, the pseudo glide path calculation module 202 may be configured within an aircraft control system. For instance, the pseudo glide path calculation module 202 may be physically located at or near an air traffic control tower and configured to transmit the pseudo approach glide path profile to the aircraft 144. In another example, the pseudo glide path calculation module 202 may be configured as flight management equipment.

In some embodiments, the pseudo glide path calculation module 202 includes one or more controllers 204. The one or more controllers 204 control aspects of the systems and methods described herein. The one or more controllers 204 may include one or more processors 208, memory 212, and a communication interface 216. The memory 212 may store (e.g., have stored upon) one or more sets of program instructions. The one or more processors 208 may be configured to execute the one or more sets of program instructions to carry out one or more of the various steps or procedures described throughout the present disclosure. The system 200 may contain other componentry used to determine and report a pseudo approach glide path profile 140 that may or may not be considered part of the glide path calculation module 202. Therefore, the description herein should not be interpreted as a limitation of the present disclosure, but as an illustration.

In some embodiments, the system 200 includes a user interface 220 communicatively coupled to the one or more controllers 204 and configure to transmit information between the system and a user (e.g., the pilot of an aircraft). The user interface 220 may include any technology configured to assist interaction between the user and the system 200 including but not limited to keyboards, speakers, joysticks, and displays 224. For example, the user interface 220 may be configured as any type of display 224 including but not limited to a synthetic vision system (SVS) display, an augmented reality (AR) display, a head up display (HUD), a multi-function display (MFD), or a virtual reality (VR display). For instance, the system 200 may include a SVS display that overlays a predicted path on a virtual map of an airport layout. In another example, the display 224 may be configured as flight management equipment (e.g., such as a flight management system display, where the predicted path is overlaid on the display 224).

In some embodiments, the system 200 includes an aircraft status database 230 (e.g., configured as a server) communicatively coupled to the pseudo glide path calculation module 202 and configured to send aircraft status data to the pseudo glide path calculation module 202. The aircraft status data may include any type of information including but not limited to aircraft airspeed (e.g., indicated true airspeed, groundspeed, calibrated airspeed), aircraft velocity, aircraft position, outside temperature, outside wind speed), and aircraft configuration (e.g. aircraft weight, or aircraft type). The aircraft status database 230 may be disposed on board the aircraft 144. For example, the aircraft status database 230 may be configured as a takeoff and landing (TOLD) database that is part of or communicatively coupled to the flight data processing system. In another example, the aircraft status database may be disposed within a base aircraft control system (e.g., data is sent wirelessly to the pseudo glide path calculation module 202).

In some embodiments, the system 200 includes a runway database 234 (e.g., configured as a server) that includes communicatively coupled to the pseudo glide path calculation module 202 and configured to send runway environmental data to the pseudo glide path calculation module 202. Runway environmental data may include any type of information including but not limited to runway dimension, runway slope, runway friction, weather conditions, runway surface conditions (e.g., ice, snow, or slush), presence or absence of the preceding aircraft 146, and the wake turbulence data relevant to a preceding aircraft 146. The runway database 234 may be disposed on board the aircraft 144. For example, the runway database 234 may be configured as a navigation database (NavDB). In another example, the runway database 234 may be disposed within a base aircraft control system (e.g., data is sent wirelessly to the pseudo glide path calculation module 202). It should be understood that the aircraft status database 230 and the runway database 234 may combined as a single database, separated into multiple databases, or store different types of data. For example, the aircraft status database 230 may store airport weather data. Therefore, the above description should not be interpreted as a limitation of the present disclosure, but as an illustration.

In some embodiments, the system 200 includes a transmitter 238 configured to transmit data from the pseudo glide path calculation module 202. The transmitter 238 may transmit the data to any appropriate receiver, ground station, or communication system. For example, the transmitter 238 may transmit data to Aeronautical Operational Control (AOC). In another example, the transmitter 238 may be configured to transmit landing data (e.g., pseudo displaced threshold and/or pseudo approach glide path profile data) to air traffic control (ATC). The transmitter 238 may be any transmitter 238 used for aircraft 144 to transmit aircraft communication to any appropriate receiver, station, or communication system.

In some embodiments, the pseudo glide path calculation module calculates the pseudo displaced threshold 132 based the instructed exit path, the presence or absence of a preceding aircraft 146, and data received from the aircraft status database 230 and the runway database 234. For example, when an instructed exit path **12*h* is transmitted to the aircraft, the pseudo glide path calculation module 202 calculates what length of runway would be required to safely land and brake so that the aircraft may safely turn onto the instructed exit path 12*h*. The calculation of the pseudo displaced threshold 132** may involve one or more of the data parameters discussed above (e.g., runway surface conditions).

Additionally, the pseudo glide calculation module 202 may be configured to include within the pseudo displaced threshold 132 a margin of safety. The margin of safety will allow a pilot to safely brake and turnoff the aircraft into the instructed exit path **12*h*, even if the aircraft touches down past the pseudo displaced threshold. For example, the pseudo glide calculation module 202 may include a margin of safety within the pseudo displaced threshold 132 in a range of 10% to 30%. In another example, the pseudo glide calculation module may include a margin of safety within the pseudo displaced threshold 132 of 20%. For instance, if the pseudo glide calculation module 202 calculates that an aircraft will require 1000 meters to after touchdown to brake and turnoff into the instructed exit path 112*h*, the pseudo glide calculation module may add a 20% margin of safety, or 200 meters, to the estimated required runway length needed for landing, and the pseudo displaced threshold 132 may be set at 1200 meters from the instructed exit path 112*h***. The margin of safety may also be described as a modification of a Pseudo Landing Run (PLR) calculation. For example, for a 20% margin of safety, the Total Landing Run (TLR), which includes an earlier calculated PLR distance ($PLR^{ealc}$) may be represented by: $TLR=BFE*(PLR^{calc}+(0.2*PLR^{calc})$, wherein BFE is defined as a Brake Factor Error. BFE considers all or nearly all of the error defined in braking systems, which include but are not limited to factors such as: error due to differential braking, error due to differential speed of wheel as against speed of the aircraft, friction error due to various surface contaminants, and error due to excessive heat in the event of excessive breaking. BFE may configured at the software level. The BFE or one or more values used to calculate the BFE may also be acquired from original equipment manufacturers and/or auto braking system vendors.

In some embodiments, the pseudo glide path calculation module 202 calculates the pseudo approach glide path profile 140 based on pseudo displaced threshold 132 and other available data, including data received from the aircraft status database 230 and the runway database 234. For example, for a runway having a distance of 3000 meters between a runway threshold **122*a* and the instructed exit path 112*h* and having a distance of 1200 meters between a pseudo displaced threshold 132 and the instructed exit path 112*h*, the pseudo glide path calculation module 202 will calculate a pseudo approach glide path profile 140 based on the 1200-meter pseudo displaced threshold 132. The calculation of the pseudo approach glide path profile 140 may involve the pseudo displaced threshold 132** and one or more of the data parameters discussed above (e.g., aircraft velocity).

In some embodiments, the pseudo glide calculation module 202 may also be configured to determine a go-around point (e.g., a missed approach point). For example, the pseudo glide calculation module 202 may calculate a go-around point that, in the event the aircraft has not landed upon approaching the pseudo displaced threshold 132, will signal that the landing should be aborted and a go-around action be initiated.

In some embodiments, the pseudo glide calculation module 202 is configure to determine an estimated runway occupation time (eROT) and/or an actual runway occupation time aROT. The eROT is the estimate time period that the aircraft 114 will be positioned on a runway 104 from initial touch down to exiting the runway 104 (e.g., via the instructed exit path 112*h*). The eROT may be calculated via various methods based on the data received by the system 200. For example, eROT may be calculated based on $PLR^{calc}$ through the following formula, eROT=EOE* ($PLR^{calc}$*1.2/average speed), wherein average is speed estimated by a predictive braking scenario and EOE is defined as an Error of Estimation. The EOE may include one or more factor that adjusts the eROT based on predicted errors that may occur in the calculation of eROT. For example, the EOE may include one or more factors that, when combined. adjust the eROT in a range of 1.0% to 5.0%. For instance, the EOE may adjust the eROT by 1.0%. In another example, the EOE may adjust the eROT by 5.0%. In another example, the EOE may adjust the eROT by 2.5%.

In another example, a database (e.g., a database that includes a data table) may be prepared by acquiring data from one or more landing runs. This data table may include aircraft parameters data, aircraft configuration, runway data and environmental condition data (e.g., data from the aircraft status database 230 and/or the runway database 234) as well as landing data, such as average landing speed data and deceleration data. This data may be stored on the aircraft or a ground-based server (e.g., in the aircraft status database 230 in the runway database 234 or in a separate runway occupation time database). This database can be used to calculate the eROT. Once calculated, the ROT thus computed may be transmitted to any appropriate receiver, ground station, or communication system. For example, the transmitter 238 may transmit the eROT to the ATC and/or AOC. Once transmitted, the ATC and/or AOC may use the eROT data to analyze runway usage and initiate changes that may safely increase runway efficiency and/or capacity.

The aROT may be calculated by comparing the time of touchdown to the time of turnoff into the instructed exit path 112*h*. One calculated, the aROT may be stored in the system 200 (e.g., in the aircraft status database 230 in the runway database 234 or in the separate runway occupation time database) and may be transmitted to ATC and/or AOC (e.g., via the transmitter 238). Once transmitted, the ATC and/or AOC may use the aROT data to analyze runway usage and initiate changes that may safely increase runway efficiency and/or capacity.

In embodiments, the pseudo displaced threshold 132 and/or the pseudo approach glide path profile 140 are overlaid onto the display 224. For example, for a display configured as a SVS system, the pseudo displaced threshold markings 134 may appear overlaid on the runway 144 (as in FIG. 1C-E). For instance, the pseudo displaced threshold markings 134 may be depicted as yellow or some other indicative color on the SVS. In another example, the pseudo approach glide path profile 140 may appear overlaid on the runway 144 or a runway approach screen (as in FIG. 1D). For instance, the pseudo approach glide path profile 140 may be depicted as yellow or some other indicative color on the SVS or on other systems, such as a runway awareness and advisory system (RAAS).

In some embodiments, one or more of the one or more controllers 204 are communicatively coupled (e.g., wirelessly and/or wireline) to other components of the system 200. For example, one or more of the one or more controllers 204 may be communicatively coupled to the user interface 220 (e.g., the display 224), the aircraft status database 230, the runway database 234, and/or the transmitter 238. The one or more controllers 204 may also be communicatively coupled to other componentry within the within the system 200 that are not listed here. Therefore, the above description should not be interpreted as a limitation of the present disclosure, but as an illustration.

The one or more processors 208 may include any one or more processing elements known in the art. In this sense, the one or more processors 208 may include any microprocessor device configured to execute algorithms and/or program instructions. In general, the term "processor" may be broadly defined to encompass any device having one or more processing elements, which execute a set of program instructions from a non-transitory memory medium (e.g., the memory 212), where the one or more sets of program instructions is configured to cause the one or more processors 208 to carry out any of one or more process steps.

The memory 212 may include any storage medium known in the art suitable for storing the one or more sets of program instructions executable by the associated one or more processors 208. For example, the memory 212 may include a non-transitory memory medium. For instance, the memory 212 may include, but is not limited to, a read-only memory (ROM), a random-access memory (RAM), a magnetic or optical memory device (e.g., disk), a magnetic tape, a solid-state drive, and the like. In addition, the memory 212 may be configured to store user input information. The memory 212 may be housed in a common controller housing with the one or more processors 208. The memory 212 may, alternatively or in addition, be located remotely with respect to the spatial location of the processors 208, or the one or more controllers 204. For example, the one or more processors 208 and/or one or more controllers 204 may access a remote memory 212 accessible through a network (e.g., wireless, and the like) via one or more communication interfaces 216.

The one or more communication interfaces 216 may be operatively configured to communicate with components of the one or more controllers 204. For example, the one or more communication interfaces 216 may be configured to retrieve data from the one or more processors 208 or other devices, transmit data for storage in the memory 212, retrieve data from storage in the memory 212, and so forth. The one or more communication interfaces 206 may also be communicatively coupled with the one or more processors 208 to facilitate data transfer between components of the one or more controllers 204 and the one or more processors 208. It should be noted that while the one or more communication interfaces 216 is described as a component of the one or more controllers 204, one or more components of the one or more communication interfaces 216 may be implemented as external components communicatively coupled to the one or more controllers 204 via a wired and/or wireless connection. The one or more controllers 204 may also include and/or connect to one or more user interfaces 220 (e.g., display 224).

Figure 3:
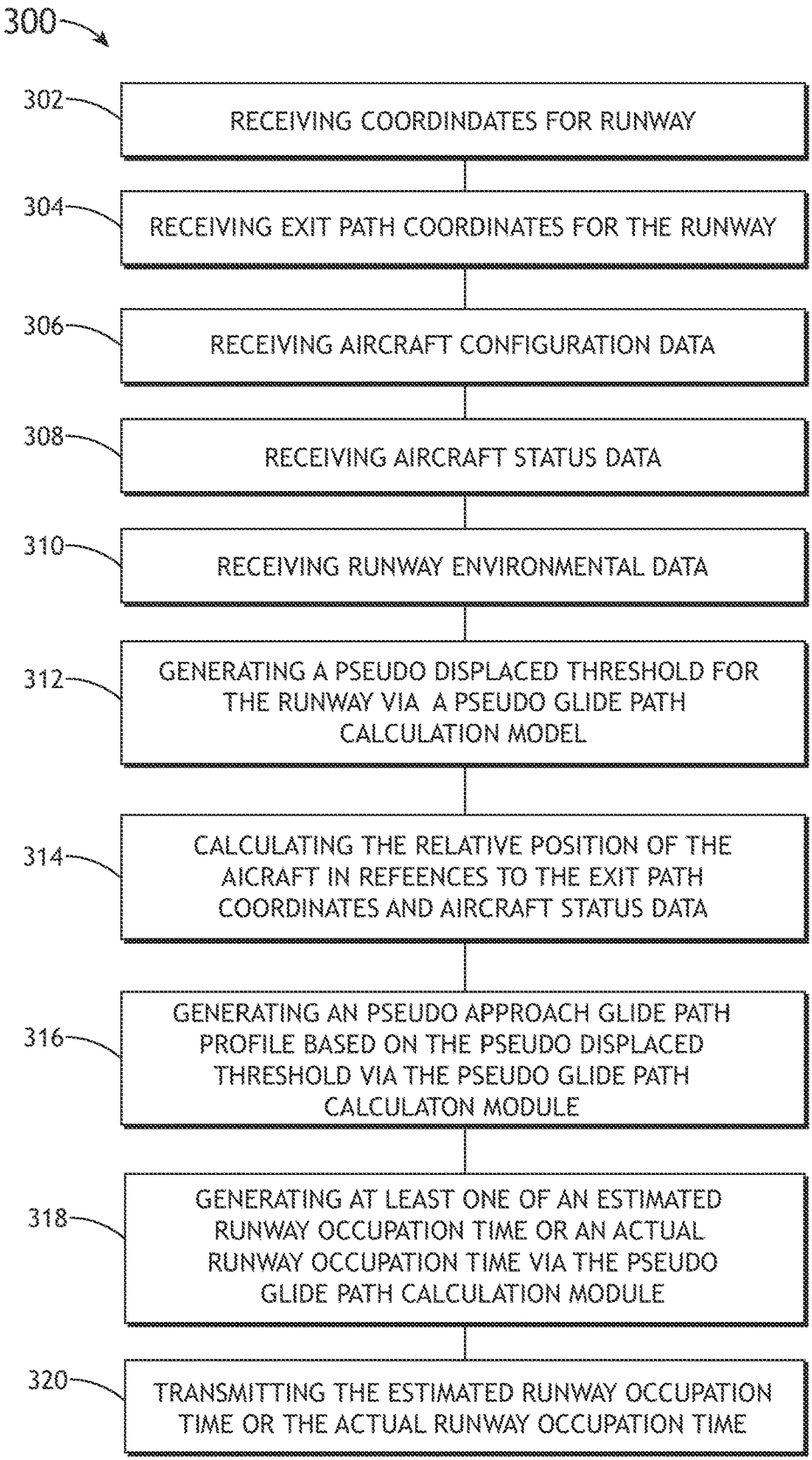
FIG. 3 is a flow diagram illustrating a method for generating a pseudo approach glide path profile, in accordance with one or more embodiments of this disclosure.

FIG. 3 is a block diagram illustrating a method 300 for determining the pseudo displaced threshold 132 and the pseudo approach glide path profile 140, in accordance with one or more embodiments of this disclosure. In one embodiment, the method includes a step 302 of receiving coordinated for the runway 144. For example, the pseudo glide path calculation module 202 may receive runway coordinates, or other runway information, from a runway database 234.

In some embodiments, the method 300 includes a step 304 of receiving exit path coordinated for the runway 144. For example, the pseudo glide path calculation module 202 may receive exit path coordinates from the ATC or AOC (e.g., automatically or manually entered in via the user interface 220. In another example, the pseudo glide path calculation module 202 may receive exit path coordinates from the runway database 234.

In embodiments, the method 300 includes a step 306 of receiving aircraft configuration data. For example, the pseudo glide path calculation module 202 may receive aircraft configuration data in the form of aircraft braking ability or aircraft weight.

In some embodiments, the method 300 includes a step 308 of receiving aircraft status data. For example, the pseudo glide path calculation module 202 may receive status data from the aircraft status database 230. For instance, the pseudo glide path calculation module 202 may receive aircraft velocity data from an aircraft status database 230 configured as any system or equipment capable of processing flight data(e.g., such as a flight management system)The pseudo glide path calculation module 202 may also receive aircraft configuration data from the aircraft status database (e.g., aircraft weight or braking characteristics).

In some embodiments, the method 300 includes a step 310 of receiving environmental data. For example, the pseudo glide path calculation module 202 may receive current weather data for the runway. The pseudo glide path calculation module 202 may receive the data from either the aircraft status database 230 or the runway database 234.

In some embodiments, the method 300 includes a step 312 of generating a pseudo displaced threshold 132 for the runway via the pseudo glide path calculation module 202. The pseudo displaced threshold calculation may utilize aircraft configuration data, aircraft status data, and/or runway environmental data.

In some embodiments, the method 300 includes a step 314 of calculating the relative position of the aircraft 144 in reference to the exit path coordinates and the aircraft status data. For example, the relative position of the aircraft 144 (e.g., as determined by aircraft status data in the form of GPS coordinates and altimeter readings) in reference to the exit path coordinates may be calculated by the pseudo glide path calculation module 202.

In some embodiments, the method 300 includes a step 316 of generating the pseudo approach glide path profile 140 based on the displaced pseudo threshold via the pseudo glide path calculation module 202. For example, the pseudo glide path calculation module 202 may utilize any aircraft configuration data, aircraft status data, runway environmental data along with runway coordinates to generate the pseudo approach glide path profile 140

In some embodiments, the method 300 includes a step 318 of generating at least one of an eROT or an aROT via the pseudo glide path calculation module. In some embodiments, the method includes a step of transmitting at least one of the eROT or aROT. The eROT and/or aROT may be transmitted to an ATC, an AOC, an aircraft database (e.g., a local server), or a separate ground-based server.

It is to be understood that embodiments of the methods disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

Although inventive concepts have been described with reference to the embodiments illustrated in the attached drawing figures, equivalents may be employed and substitutions made herein without departing from the scope of the claims. Components illustrated and described herein are merely examples of a system/device and components that may be used to implement embodiments of the inventive concepts and may be replaced with other devices and components without departing from the scope of the claims. Furthermore, any dimensions, degrees, and/or numerical ranges provided herein are to be understood as non-limiting examples unless otherwise specified in the claims.

What is claimed is:

1. A system to assist piloting an aircraft in landing phase comprising:

a pseudo glide path calculation module comprising:

one or more processors; and a memory communicatively coupled to the one or more processors and having instructions stored upon, which when executed by the one or more processors, cause the one or more processors to:

receive coordinates for a runway;

receive exit path coordinates for the runway;

receive aircraft configuration data; wherein the aircraft configuration data comprises an aircraft weight;

receive aircraft status data; wherein the aircraft status data comprises aircraft velocity data;

receive runway environmental data; wherein the runway environmental data comprises an estimated wake turbulence of a preceding aircraft landing on the runway;

calculate a relative position of the aircraft in reference to the exit path coordinates and the runway environmental data;

generate a pseudo displaced threshold for the runway based on the exit path coordinates, the aircraft configuration data, the aircraft status, and the runway environmental data, wherein the pseudo displaced threshold is calculated so that the aircraft may turn onto the exit path coordinates and to ensure the aircraft is not affected by the estimated wake turbulence of the preceding aircraft; and generate a pseudo approach glide path profile based on the pseudo displaced threshold; and a display, wherein the display overlays the pseudo displaced threshold and the pseudo approach glide path profile onto the runway.

2. The system of claim 1, further comprising an aircraft status database configured to send aircraft configuration data to the pseudo glide path calculation module.

3. The system of claim 1, further comprising a runway database configured to send at least one of the coordinates for the runway or the coordinates for the exit path of the runway to the pseudo glide path calculation module.

4. The system of claim 1, wherein the instructions stored upon the memory further comprise calculating an estimated runway occupation time.

5. The system of claim 4, further comprising a transmitter configured to transmit the estimated runway occupation time to an air traffic system.

6. The system of claim 1, wherein the runway environmental data comprises an estimated landing time, an estimated landing speed, and the estimated wake turbulence of the preceding aircraft landing on the runway.

7. The system of claim 1, wherein the pseudo displaced threshold is configured to include a margin of safety.

8. The system of claim 1, wherein the instructions stored upon the memory further include generating a go-around point.

9. The system of claim 1, wherein the approach pseudo glide path is configured to decrease runway occupation time.

10. The system of claim 1, wherein the pseudo displaced threshold is a virtualized threshold.

* * * * *